US010406826B2

(12) United States Patent
Hirano et al.

(10) Patent No.: US 10,406,826 B2
(45) Date of Patent: Sep. 10, 2019

(54) TABLET PRINTING APPARATUS AND PRINTING METHOD

(71) Applicant: SHIBAURA MECHATRONICS CORPORATION, Yokohama-shi (JP)

(72) Inventors: Azusa Hirano, Yokohama (JP); Yasutsugu Tsuruoka, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 15/579,236

(22) PCT Filed: May 11, 2016

(86) PCT No.: PCT/JP2016/064007
§ 371 (c)(1),
(2) Date: Dec. 4, 2017

(87) PCT Pub. No.: WO2016/194565
PCT Pub. Date: Dec. 8, 2016

(65) Prior Publication Data

US 2018/0170068 A1 Jun. 21, 2018

(30) Foreign Application Priority Data

Jun. 5, 2015 (JP) ..... 2015-114818

(51) Int. Cl.
*B41J 3/407* (2006.01)
*A61J 3/06* (2006.01)
(Continued)

(52) U.S. Cl.
CPC ..... *B41J 3/4073* (2013.01); *A61J 3/007* (2013.01); *A61J 3/06* (2013.01); *B41F 17/36* (2013.01);
(Continued)

(58) Field of Classification Search
CPC .... B41J 11/0095; B41J 3/4073; B41J 11/008; B41J 2/2135; B41J 2/04526;
(Continued)

(56) References Cited

U.S. PATENT DOCUMENTS

2015/0174916 A1 6/2015 Hara et al.
2015/0191028 A1 7/2015 Hara et al.
2016/0180515 A1 6/2016 Seo et al.

FOREIGN PATENT DOCUMENTS

JP 7-81050 A 3/1995
JP 2002-39957 A 2/2002
(Continued)

OTHER PUBLICATIONS

International Search Report dated Aug. 2, 2016, in PCT/JP2016/064007, filed May 11, 2016.

*Primary Examiner* — Jannelle M Lebron
(74) *Attorney, Agent, or Firm* — Oblon, McClelland, Maier & Neustadt, L.L.P.

(57) ABSTRACT

According to one embodiment, a tablet printing device 1 includes: a conveyer 10 configured to convey a tablet T; a laser displacement meter 30 configured to emit laser beams to the tablet T conveyed by the conveyer 10 and receive the laser beams reflected by the tablet T; a determination unit 81 configured to determine whether there is a split line on the upper surface of the tablet T conveyed by the conveyer 10 based on an output value of the laser displacement meter 30; and a printing unit 50 configured to perform printing on the tablet T conveyed by the conveyer 10 based on a determination result obtained by the determination unit 81.

15 Claims, 5 Drawing Sheets

(51) Int. Cl.

| | |
|---|---|
| ***B41F 17/36*** | (2006.01) |
| ***A61J 3/00*** | (2006.01) |
| ***B41J 11/00*** | (2006.01) |
| ***B41M 5/00*** | (2006.01) |
| ***B41J 2/01*** | (2006.01) |

(52) U.S. Cl.
CPC ..... *B41J 2/01* (2013.01); *B41J 3/407* (2013.01); *B41J 11/007* (2013.01); *B41J 11/008* (2013.01); *B41J 11/0095* (2013.01); *B41M 5/0047* (2013.01)

(58) Field of Classification Search
CPC .... B41J 2/04581; B41J 2/125; B41J 2/14153; B41J 2/145; B41J 2/1714; A61J 3/06; A61J 3/007; B41M 5/0088; B41M 5/0047; B41F 17/36
See application file for complete search history.

(56) References Cited

FOREIGN PATENT DOCUMENTS

| | | | |
|---|---|---|---|
| JP | 2004-219119 | A | 8/2004 |
| JP | 2013-121432 | A | 6/2013 |
| JP | 2014/013974 | A1 | 1/2014 |
| WO | WO 01/10464 | A1 | 2/2001 |
| WO | 2015/008742 | A1 | 1/2015 |

TABLET PRINTING APPARATUS AND PRINTING METHOD

TECHNICAL FIELD

Embodiments described herein relate generally to a tablet printing device and a tablet printing method.

BACKGROUND ART

Generally, a tablet printing device prints identification information such as letters or characters (e.g., alphabet, kana, and numeric) or marks (e.g., symbols and figures) on the surface of a tablet in order to identify the tablet. As the tablet printing device, an inkjet tablet printing device, which performs printing on a tablet in a noncontact manner, has been developed due to the ease of changing letters, characters or marks, high print quality, and the like. The inkjet tablet printing device ejects ink (e.g., edible ink) toward a tablet being conveyed by a conveyor belt or the like to print identification information on the surface of the tablet.

There are various types of tablets as a tablet to be printed. The various types of tablets include those having front and back sides. Examples of the tablets having the front and back sides include a tablet with a split line for dividing the tablet on one side. In this tablet, generally, a surface with a split line is regarded as the front side, and a surface without a split line is regarded as the back side. Identification information may be printed on the surface with a split line. Therefore, it is desirable to supply tablets on the conveyor belt with the front side (the surface with a split line) thereof facing up.

PRIOR ART DOCUMENT

Patent Document

[Patent Document 1] Japanese Unexamined Patent Application Publication No. Hei7-81050

SUMMARY OF THE INVENTION

Problems to be Solved by the Invention

However, other process of aligning the front and back sides of the tablets is required so as to supply the tablets onto the conveyor belt with their front side facing up, leading to a decrease in the productivity and an increase in the cost. For this reason, tablets may be supplied onto the conveyor belt without aligning the front and back sides of the tablets. In this case, in order to print identification information on the front surfaces of the tablets, it is necessary to determine whether the upper surface of each tablet on the conveyor belt is the front surface, i.e., whether there is a split line on the upper surface of each tablet on the conveyor belt. A camera may be used to photograph the upper surface of the tablet on the conveyor belt to determine the presence or absence of a split line based on the image.

However, in the case of using a camera as described above, illumination is required for illuminating the upper surface of each tablet on the conveyor belt in addition to the camera for photographing the upper surface of the tablet. This causes the complication of the device and increase of the device cost. Besides, this requires image processing for determining the presence or absence of a split line based on an image captured by the camera, and the speed of determining the front/back of the tablet is delayed at least for the time taken for the image processing.

An object of the present invention is to provide a tablet printing device and a tablet printing method capable of realizing the simplification of the device, the reduction of the device cost, and an improvement in the speed of determining the front/back of tablets.

Means of Solving the Problems

According to one embodiment, a tablet printing device includes: a conveyer configured to convey a tablet; a laser displacement meter configured to emit laser beams to the tablet conveyed by the conveyer and receive the laser beams reflected by the tablet; a determination unit configured to determine whether there is a split line on the upper surface of the tablet conveyed by the conveyer based on an output value of the laser displacement meter; and a printing unit configured to perform printing on the tablet conveyed by the conveyer based on a determination result obtained by the determination unit.

According to another embodiment, a tablet printing method includes: a first step in which a laser displacement meter emits laser beams to a tablet conveyed and receives the laser beams reflected by the tablet; a second step of determining whether there is a split line on the upper surface of the tablet conveyed based on an output value of the laser displacement meter; and a third step of performing printing on the tablet conveyed based on a determination result.

Effects of the Invention

According to the embodiments, it is possible to realize the simplification of the device, the reduction of the device cost, and an improvement in the speed of determining the front/back of tablets.

MODES FOR CARRYING OUT THE INVENTION

First Embodiment

A first embodiment will be described with reference to FIGS. 1 to 4.

Figure 1:
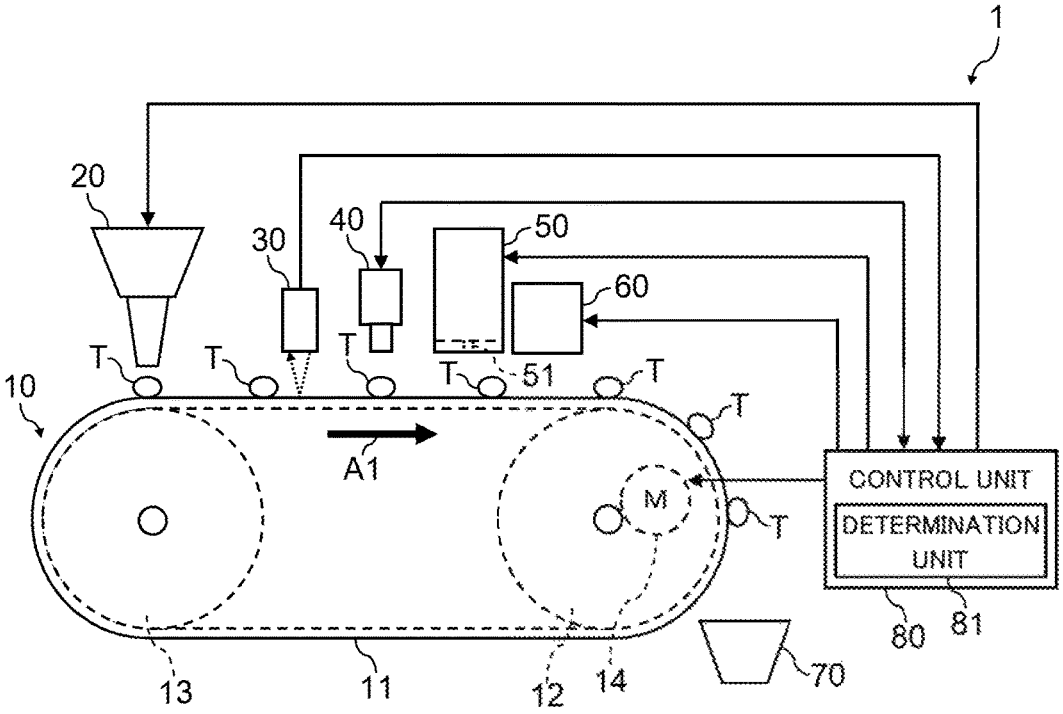
FIG. 1 is a diagram illustrating a schematic configuration of a tablet printing device according to a first embodiment.
Figure 2:
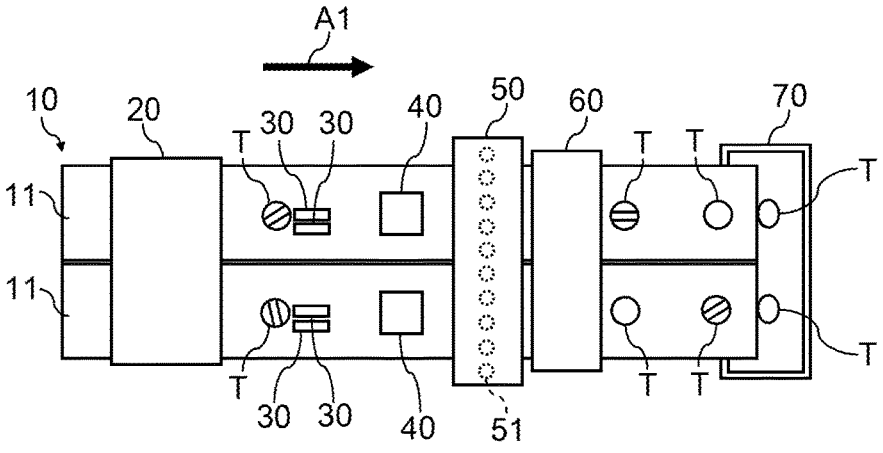
FIG. 2 is a plan view illustrating a schematic configuration of the tablet printing device of the first embodiment.

As illustrated in FIGS. 1 and 2, a tablet printing device 1 of the first embodiment includes a conveyor 10 configured to convey tablets T to be printed, a supply unit 20 configured to supply the tablets T to the conveyor 10, a plurality of laser displacement meters 30 arranged above the conveyor 10, a plurality of imaging units 40 configured to capture images of the tablets T conveyed by the conveyor 10, a printing unit 50 configured to perform printing on the tablets T conveyed by the conveyor 10, a drying unit 60 configured to dry the tablets T conveyed by the conveyor 10 after the printing, a collecting unit 70 configured to collect the tablets T dried, and a control unit 80 configured to control each unit. In this embodiment, the tablet T is described as a flat tablet having a perfect circular shape in a plan view.

The conveyor 10 includes a plurality of conveyor belts 11, a first pulley 12, a second pulley 13, and a motor 14. The conveyor belts 11 are each formed to be endless and are wrapped around the first pulley 12 and the second pulley 13 in parallel. The first pulley 12 is connected to the motor 14 serving as a drive source, and functions as a drive pulley. The second pulley 13 functions as a driven pulley. The motor 14 is electrically connected to the control unit 80, and is driven under the control of the control unit 80.

In the conveyor 10, each of the conveyor belts 11 rotates with the second pulley 13 due to the rotation of the first pulley 12 by the motor 14, and conveys the tablets T thereon in the direction indicated by arrow A1 in FIG. 2 (conveyance direction A1). Each of the conveyor belts 11 constitutes a plurality of conveying lines. The conveyor 10 is configured to be capable of conveying the tablets T in a row while holding the tablets T on each of the conveyor belts 11 by suction and releasing the holding of the tablets T at a desired position. However, the conveyor 10 need not necessarily have a mechanism of sucking and holding the tablets T. Various conveying mechanisms can be used as the conveyor 10.

The supply unit 20 is located at the end of the conveyor 10, i.e., at the end of each of the conveyor belts 11 on the upstream side in the conveyance direction A1. The supply unit 20 is configured to be capable of containing a number of tablets T and supplying the tablets T to each of the conveyor belts 11 one by one at predetermined intervals. The supply unit 20 supplies the tablets T to the conveyor belts 11 regardless of the front and back sides of the tablets T. In the tablet T, a surface with a split line (e.g., groove) is the front side and a surface without a split line is the back side. The supply unit 20 is electrically connected to the control unit 80, and is driven under the control of the control unit 80.

The laser displacement meters 30 are located on the downstream side of the supply unit 20 in the conveyance direction A1. There are provided two laser displacement meters 30 above each of the conveyor belts 11. The two laser displacement meters 30 corresponding the conveyor belt 11 are arranged at a position where they can irradiate laser beams onto the upper surface of the tablet T conveyed by the conveyor belt 11, and are arranged in a direction intersecting (e.g., perpendicular to) the conveyance direction A1 in a horizontal plane. For example, various laser sensors such as reflection laser sensors can be used as the laser displacement meters 30. Examples of the shape of the laser beams include various shapes such as spot and line.

Each of the laser displacement meters 30 irradiates laser beams toward the tablet T on the conveyor belt 11, receives the laser beams reflected from the tablet T (reflected light), and sends the reflection intensity of the laser beams to the control unit 80 as an output value. The reflection intensity of the laser beams is information indicating the distance between the surface of the conveyor belt 11 or the upper surface of the tablet T on the conveyor belt 11 and the laser displacement meter 30. The output value is higher as the distance becomes shorter. In addition, the laser displacement meter 30 detects the presence or absence of the tablet T on the conveyor belt 11 by irradiating and receiving laser beams, thereby also functioning as a trigger sensor for the imaging unit 40 and the printing unit 50. Each of the laser displacement meters 30 is electrically connected to the control unit 80, and sends information on the reflection intensity of laser beams and a trigger signal to the control unit 80.

The imaging units 40 are located on the downstream side of the laser displacement meters 30 in the conveyance direction A1. There is provided one imaging unit 40 above each of the conveyor belts 11. The imaging units 40 are arranged in a direction intersecting (e.g., perpendicular to) the conveyance direction A1 in a horizontal plane. The imaging unit 40 performs imaging at the timing based on a trigger signal sent from the laser displacement meter 30, captures an image including the upper surface of the tablet T, and sends the image to the control unit 80. For example, various imaging units having an imaging element such as a charge-coupled device (CCD) or a complementary metal-oxide semiconductor (CMOS) can be used as the imaging units 40. Each of the imaging units 40 is electrically connected to the control unit 80, and is driven under the control of the control unit 80.

The printing unit 50 is an inkjet print head that ejects ink from a plurality of nozzles 51. The printing unit 50 is located on the downstream side of the imaging units 40 in the conveyance direction A1. The printing unit 50 is arranged above each of the conveyor belts 11 such that the arranging direction of the nozzles 51 are aligned in a direction intersecting (e.g., perpendicular to) the conveyance direction A1 in a horizontal plane. The printing unit 50 is configured to be capable of applying ink to the tablets T on each of the conveyor belts 11. Examples of the printing unit 50 include various types of inkjet print heads having a driving element such as a piezoelectric element, a heat generating element or a magnetostrictive element. The printing unit 50 is electrically connected to the control unit 80, and is driven under the control of the control unit 80.

The drying unit 60 is located on the downstream side of the printing unit 50 in the conveyance direction A1. The drying unit 60 is provided above each of the conveyor belts 11 so as to intersect with (e.g., be perpendicular to) the conveyance direction A1 in a horizontal plane. The drying unit 60 is configured to be capable of drying the ink applied to each of the tablets T on each of the conveyor belts 11. Examples of the drying unit 60 include various types of dryers such as a heater for drying an object to be dried by radiant heat or a blower for drying an object to be dried with warm air or hot air. The drying unit 60 is electrically connected to the control unit 80, and is driven under the control of the control unit 80.

The collecting unit 70 is located on the downstream side of the drying unit 60 in the conveyance direction A1. The collecting unit 70 is provided at the end of the conveyor 10, i.e., at the end of each of the conveyor belts 11 on the downstream side in the conveyance direction A1. The collecting unit 70 is configured to be capable of sequentially receiving the tablets T dropped as each of the conveyor belts 11 releases the holding thereof, and collect the tablets T. When each of the tablets T on each of the conveyor belts 11 reaches a desired position, e.g., the end of the conveyor belt 11 on the downstream side in the conveyance direction A1, the conveyor 10 releases the holding of the tablet T.

The tablets T are supplied onto each of the conveyor belts 11 regardless of the front and back sides thereof, and the printing unit 50 performs printing only when the tablet T faces up (the surface with a split line faces up). For this reason, printed tablets T and unprinted tablets T are present on each of the conveyor belts 11 on the downstream side of the printing unit 50. Therefore, the collecting unit 70 is configured to be capable of distinguishing between printed tablets T and unprinted tablets T and storing them. For example, the collecting unit 70 lets the printed tablets T drop and stores them in a first container in the collecting unit 70, while it blows air to the unprinted tablets T being dropped and stores them in a second container in the collecting unit 70.

The control unit 80 includes a microcomputer that intensively controls each unit and a storage unit that stores processing information, various programs and the like (both not illustrated). The control unit 80 controls the supply unit 20, the imaging units 40, the printing unit 50, and the drying unit 60 based on the processing information and the various programs. Further, the control unit 80 receives the reflection intensity of laser beams sent from each of the laser displacement meters 30, i.e., the reflection intensity information of the laser beams, images sent from the imaging units 40, and the like.

The control unit 80 includes a determination unit 81 that determines whether there is a split line on the upper surface of the tablet T. The determination unit 81 determines the presence or absence of a split line on the upper surface of the tablet T based on the reflection intensity information of each laser beam sent from each of the laser displacement meters 30. Hereinafter, for the sake of convenience, when it is required to distinguish the two laser displacement meters 30 corresponding to one conveyor belt 11, one of them is referred to as a first laser displacement meter 30, and the other is referred to as a second laser displacement meter 30.

Figure 3:
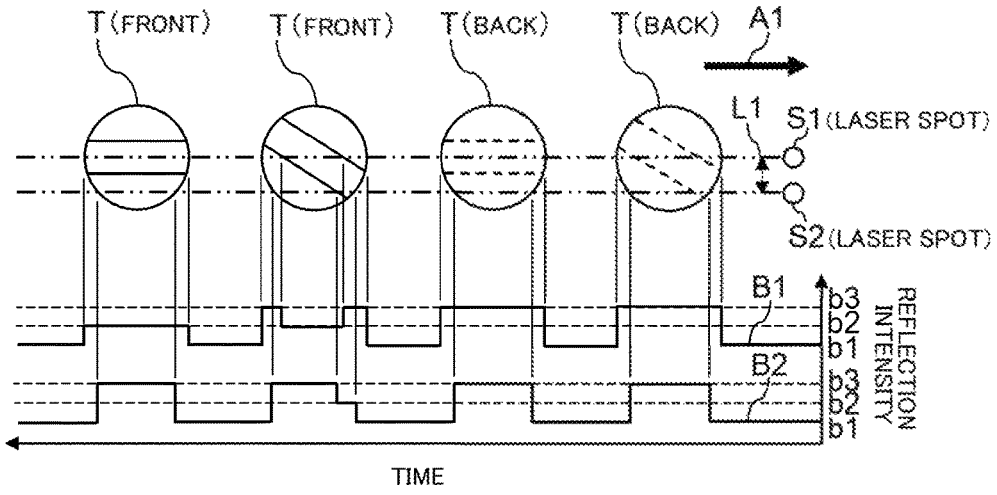
FIG. 3 is a diagram for explaining front/back determination (determination of the presence or absence of a split line) and orientation determination (determination of the orientation of the split line) for tablets according to the first embodiment.

As illustrated in FIG. 3, the laser spot S1 of the first laser displacement meter 30 is set to pass approximately the center of the upper surfaces of the tablets T that are relatively moving. The laser spot S2 of the second laser displacement meter 30 is set to deviate from the laser spot S1 by a predetermined distance L1 in a direction perpendicular to the conveyance direction A1 in a horizontal plane. The predetermined distance L1 is, for example, a length slightly shorter than the radius of the tablet T. The tablets T are conveyed in a line with their center located on a predetermined line. Although there are some whose center deviates from the predetermined line, since this deviation is small, the tablets T are conveyed in almost a line.

The output (reflection intensity of laser beams) B1 of the first laser displacement meter 30 varies according to the distance between the first laser displacement meter 30 and the surface of the conveyor belt 11 or the upper surface of the tablet T on the conveyor belt 11. For example, the output B1 becomes reflection intensity b1 when the tablet T is not present on the conveyor belt 11, i.e., when the laser spot S1 hits the surface of the conveyor belt 11. The output B1 becomes reflection intensity b2 when the laser spot S1 hits the upper surface in a split line (e.g., groove) of the tablet T on the conveyor belt 11. The output B1 becomes reflection intensity b3 when the laser spot S1 hits the upper surface other than the split line of the tablet T on the conveyor belt 11 (b1<b2<b3). Since the output B1 varies according to the change in the height of the tablet T on the conveyor belt 11, in other words, the first laser displacement meter 30 detects the height of the tablet T on the conveyor belt 11. Note that the output B2 of the second laser displacement meter 30 also varies in the same manner as described above except that the laser spot S1 is replaced by the laser spot S2.

The determination unit 81 determines whether there is a split line on the upper surface of the tablet T on the conveyor belt 11 based on the output B1 of the first laser displacement meter 30 and the output B2 of the second laser displacement meter 30. For example, when either one or both of the output B1 and the output B2 is the reflection intensity b2, the determination unit 81 determines that there is a split line on the upper surface of the tablet T on the conveyor belt 11. Otherwise, the determination unit 81 determines that there is no split line on the upper surface of the tablet T on the conveyor belt 11. As another determination example, a predetermined value between the reflection intensity b1 and the reflection intensity b2 may be set as a first threshold value, and a predetermined value between the reflection intensity b2 and the reflection intensity b3 may be set as a second threshold value. In this case, when either or both of the output B1 and the output B2 is larger than the first threshold value and smaller than the second threshold value, the determination unit 81 determines that there is a split line on the upper surface of the tablet T on the conveyor belt 11. Otherwise, the determination unit 81 determines that there is no split line on the upper surface of the tablet T on the conveyor belt 11.

Further, the determination unit 81 acquires information on the orientation of the tablet T (e.g., inclination of the split line of the tablet T in a horizontal plane) based on the output B1 of the first laser displacement meter 30 and the output B2 of the second laser displacement meter 30. For example, the determination unit 81 determines the inclination degree of the split line of the tablet T with respect to the conveyance direction A1, i.e., the orientation (angle and rotation direction) of the split line based on the waveform shapes of the output B1 and the output B2. The orientation of the split line of the tablet T is determined as follows: For example, when the second tablet T from the left in FIG. 3 is detected by the laser spot S1 and the laser spot S2, the output for each is the reflection intensity b2 at a position corresponding to the split line. Specifically, when the edge of the tablet T is detected first, the output B1 is the reflection intensity b3. Thereafter, the output B1 becomes the reflection intensity b2 at the position where the split line is present and then returns to the reflection intensity b3. Since the split line is detected first, the output B2 is the reflection intensity b2, and thereafter becomes the reflection intensity b3. The relationship between the combinations of the waveform shapes of the output B1 and the output B2 and the orientation of the split line is obtained in advance through experiments, and data on each combination of angles is stored in the determination unit 81. With this, the determination unit 81 compares the combination of the waveform shapes of the actual outputs B1 and B2 with the data stored in advance, thereby determining the orientation of the split line. The orientation information is used for a printing process performed by the control unit 80.

Described next is a printing step (printing process) performed by the tablet printing device 1.

Each of the conveyor belts 11 of the conveyor 10 rotates in the conveyance direction A1 due to the rotation of the first pulley 12 and the second pulley 13 caused by the motor 14. The supply unit 20 sequentially supplies the tablets T onto each of the conveyor belts 11 at predetermined intervals while the conveyor belts 11 are rotating. As a result, the tablets T are conveyed in almost a line on each of the conveyor belts 11.

Each of the laser displacement meters 30 detects the arrival of each tablet T on each of the conveyor belts 11. Each of the laser displacement meters 30 also detects the height of each tablet T (first step). At this time, each of the laser displacement meters 30 acquires the reflection intensity information of laser beams, and sends it to the control unit 80. The determination unit 81 determines whether there is a split line on the upper surface of the tablet T on each of the conveyor belts 11 based on the reflection intensity information of the laser beams acquired by each of the laser displacement meters 30. When there is a split line on the tablet T, the determination unit 81 further determines the orientation (angle and rotation direction) of the split line (second step). When the determination unit 81 determines that there is a split line on the upper surface of the tablet T (the upper surface is the front), printing on the tablet T is permitted. On the other hand, when it is determined that there is no split line on the tablet T (the upper surface is the back), printing on the tablet T is prohibited. The orientation information indicating the orientation of the split line determined by the determination unit 81 is used for the printing process performed by the control unit 80.

Thereafter, each tablet T on each of the conveyor belts 11 is photographed by the imaging units 40 in each of the conveyor belts 11. The imaging unit 40 photographs the upper surface of each tablet T at the timing based on a trigger signal sent from the laser displacement meter 30, and sends the image captured to the control unit 80. The control unit 80 generates position information of the tablet T (e.g., the position of the tablet T in a horizontal plane) based on individual images sent from the imaging units 40. Since it is not necessary to capture an image of the tablet T on which printing is prohibited, the control unit 80 performs appropriately control of skipping the photographing for the tablet T on which printing is prohibited. However, when the image of the tablet T on which printing is prohibited is used in another process, the tablet T on which printing is prohibited may be photographed.

The printing unit 50 performs printing on each tablet T on each of the conveyor belts 11 based on the orientation information and the position information of the tablet T described above at the timing based on a trigger signal sent from the laser displacement meters 30 for each of the conveyor belts 11 (third step). Ink is appropriately ejected from each of the nozzles 51 of the printing unit 50 to print identification information, such as a letter or a character, a mark, or the like, on the upper surface of the tablet T so as to avoid the split line or along the split line. The control unit 80 performs appropriately control of skipping the printing on the tablet T on which printing is prohibited. In this manner, the printing unit 50 performs printing on the tablets T on each of the conveyor belts 11 based on the determination result (result of the determination as to the presence or absence of a split line and the orientation) obtained by the determination unit 81 and the position information of the tablets T.

The drying unit 60 dries the ink applied to each tablet T on each of the conveyor belts 11 while the tablet T is passing under the drying unit 60. When the tablet T with ink dried arrives at the downstream end of each of the conveyor belts 11, it is released from the state of being held by each of the conveyor belts 11. The tablet T drops from each of the conveyor belts 11 and is collected by the collecting unit 70. For example, the printed tablet T drops as it is and is stored in the first container in the collection unit 70, and the unprinted tablet T is blown by air while dropping and collected in the second container in the collection unit 70.

In such a printing process, the determination unit 81 determines the presence or absence of a split line on the upper surface of the tablet T, i.e., determines the front/back of the tablet T, based on the reflection intensity information of laser beams acquired by the laser displacement meters 30. Thus, the front/back of the tablet T can be determined from the reflection intensity information of laser beams without the need of special processing such as image processing, etc. In the case where a new camera is provided in place of the laser displacement meters 30 to determine the front/back of the tablet T, illumination is also required in addition to the camera. This causes the complication of the device and increase of the device cost. Although the imaging units 40 may be used without newly providing a camera, this requires image processing for determining the front/back of the tablet T. As a result, the speed of determining the front/back of the tablet T is delayed by the time taken for the image processing. By using the laser displacement meters 30 to determine the front/back of the tablet T, it is possible to improve the speed of determining the front/back of the tablet T as well as to achieve the simplification of the device and the reduction of the device cost.

Moreover, orientation information of the tablet T, i.e., the orientation (angle and rotation direction) of the tablet T can be acquired by using each of the laser displacement meters 30. This eliminates the need of image processing for acquiring the orientation of the tablet T from images captured by the imaging units 40, resulting in an improvement in the printing speed. Specifically, the angle of a split line with respect to the conveyance direction A1 can be detected from the width of the reflection intensity b3 and the width of the reflection intensity b2 at the output B1 of the laser displacement meter 30. However, the rotation direction of the split line (e.g., if the angle is 10°, whether it is +10° or −10°) cannot be determined from the output B1 of the laser displacement meter 30. By the combination of the outputs B1 and B2 of the laser displacement meters 30, it is possible to determine the rotation direction of the split line. Thus, the presence or absence of a split line on the tablet T and the orientation (angle and rotation direction) of the split line can be detected at high speed with only the two laser displacement meters 30.

As described above, according to the first embodiment, each of the laser displacement meters 30 irradiates laser beams toward the tablet T on the conveyor 10, and receives the laser beams reflected from the tablet T. Thereafter, the determination unit 81 determines whether there is a split line on the upper surface of the tablet T on the conveyor 10 based on the reflection intensity of the laser beams received. This enables a determination as to the front/back of the tablet T based on the reflection intensity information of the laser beams. Accordingly, there is no need of a camera, illumination, and image processing. Thus, it is possible to realize the simplification of the device, the reduction of the device cost, and an improvement in the speed of determining the front/back of tablets.

The laser displacement meters 30 are arranged so as to irradiate laser beams to the upper surface of the tablet T on the conveyor 10. The laser displacement meters 30 are arranged in a direction intersecting (e.g., perpendicular to) the conveyance direction A1 of the tablet T in a horizontal plane. This makes it possible to reliably determine the presence or absence of a split line on the upper surface of the tablet T as compared to the case of determining it by one laser displacement meter 30. Thus, the accuracy of determination as to the front/back of the tablet T can be improved. Further, since it is possible to detect the rotation direction as well as the angle of a split line of the tablet T, the orientation (angle and rotation direction) of the split line can be determined.

Figure 4:
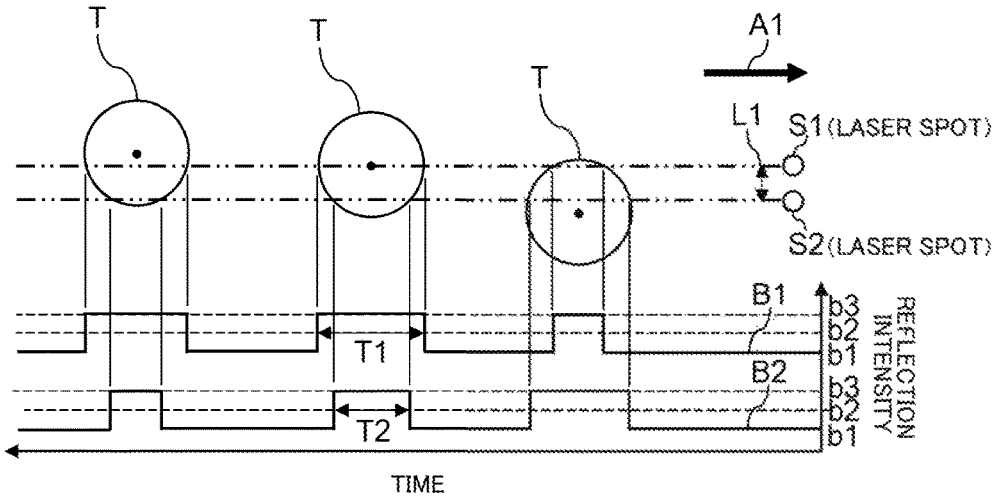
FIG. 4 is a diagram for explaining position determination for tablets according to the first embodiment.

In the above description, the position information of the tablet T is obtained from images captured by the imaging units 40; however, it is not so limited. For example, the position of the tablet T on the conveyor belts 11 can be obtained by using each of the laser displacement meters 30. For example, as the center tablet T illustrated in FIG. 4, the position of the tablet T where the laser spot S1 scans the center of the tablet T is set as a reference position. When the tablet T is located in the reference position, the output B1 and the output B2 have a waveform shape as illustrated in FIG. 4. That is, the time during which the output B1 has a value equal to or larger than the reflection intensity b2 is T1 and the time during which the output B2 has a value equal to or larger than the reflection intensity b2 is T2. As the left tablet T illustrated in FIG. 4, when the tablet T is shifted upward in FIG. 4 as compared to the reference position, the time during which the output B1 is equal to or larger than the reflection intensity b2 is shorter than T1, and the time during which the output B2 is equal to or larger than the reflection intensity b2 is shorter than T2. Besides, as the right tablet T illustrated in FIG. 4, when the tablet T is shifted downward in FIG. 4 as compared to the reference position, the time during which the output B1 is equal to or larger the reflection intensity b2 is shorter than T1, and the time during which the output B2 is equal to or larger than the reflection intensity b2 is longer than T2. In this manner, the waveform shapes of the output B1 and the output B2 vary depending on the position of the tablet T. Data indicating the relationship between the waveform shapes and the position of the tablet T is stored in advance in the determination unit 81. Thus, it is possible to detect the position in a direction perpendicular to the conveyance direction of the tablet T in a horizontal plane by comparing the waveform shapes of the actual outputs B1 and B2 with the data. In this case, since the position information can be obtained in addition to the orientation information of the tablet T, processing such as image recognition and imaging by the imaging units 40 can be omitted. As a result, it is possible to realize the simplification of the device, the reduction of the device cost, and an improvement in the printing speed.

While two laser displacement meters 30 are provided for each of the conveyor belts 11, it is not so limited. For example, one laser displacement meter may be provided for each of the conveyor belts 11. As described above, the tablets T are conveyed in a line with their center located substantially on a predetermined line. Therefore, even with only the laser spot S1 in FIG. 3, a determination can be made as to the presence or absence of a split line on the upper surface of the tablet T. This eliminates the need of image processing for determining the front/back of the tablet T. As a result, it is possible to improve the speed of determining the front/back of the tablet T. In particular, when the tablet T is conveyed with the angle of the split line being in a certain direction, there is no need to obtain the angle of the split line. Therefore, the presence or absence of a split line can be determined by only the laser spot S1, and thus printing can be performed.

Figure 5:
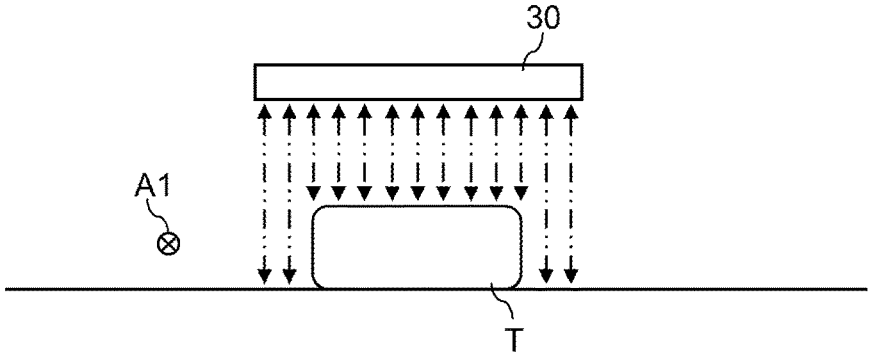
FIG. 5 is a side view for explaining a modification of the laser displacement meter pertaining to the first embodiment.

When one laser displacement meter 30 is provided for each of the conveyor belts 11, as illustrated in FIG. 5, a laser displacement meter (full-width laser displacement meter), which irradiates laser beams to the full width of the upper surface of the tablet T on the conveyor 10 in a direction intersecting (e.g., perpendicular to) the conveyance direction A1, can be used as the laser displacement meter 30. In FIG. 5, the tablet T is conveyed from the front side to the back side of the paper. In the case of using a full-width laser displacement meter, since the orientation information of the tablet T and the position information of the tablet T are obtained, processing such as image recognition and imaging by the imaging units 40 can be omitted. As a result, it is possible to realize the simplification of the device, the reduction of the device cost, and an improvement in the printing speed.

Second Embodiment

A second embodiment will be described with reference to FIGS. 6 to 9. In the second embodiment, differences (arrangement of the laser displacement meter) from the first embodiment will be described, and other explanation will be omitted. In FIG. 7, the tablet T is conveyed from the front side to the back side of the paper.

Figure 6:
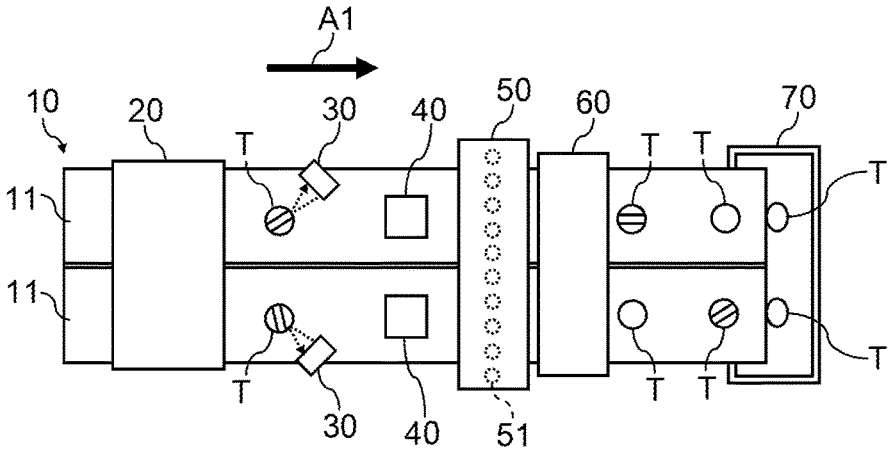
FIG. 6 is a plan view illustrating a schematic configuration of a tablet printing device according to a second embodiment.
Figure 7:
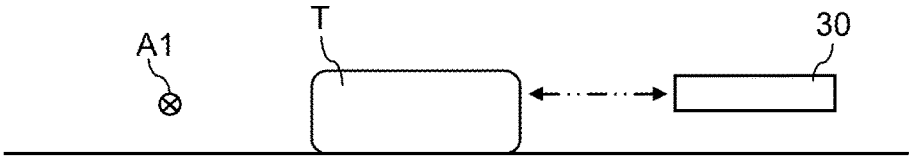
FIG. 7 is a side view for explaining the laser beam irradiation of a laser displacement meter according to the second embodiment.

As illustrated in FIGS. 6 and 7, in the second embodiment, one laser displacement meter 30 is provided for each of the conveyor belts 11. The laser displacement meter 30 is arranged so as to emit laser beams in the horizontal direction and irradiate laser beams to the upper part of the side surface of the tablet T on the conveyor belt 11 (see FIG. 7). The position irradiated with the laser beams on the side surface of the tablet T on the conveyor belt 11 is set so as to be able to detect the presence or absence of a split line on the upper surface of the tablet T conveyed by the conveyor belt 11.

Figure 8:
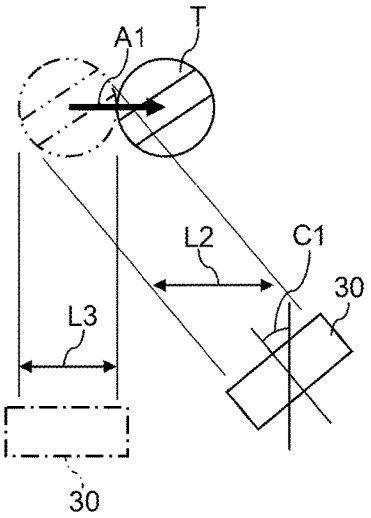
FIG. 8 is a plan view for explaining the laser beam irradiation of the laser displacement meter according to the second embodiment.

Further, as illustrated in FIG. 8, the laser displacement meter 30 is arranged so as to emit laser beams toward the upstream side in the conveyance direction A1 at a predetermined angle C1 (e.g., 40°) with respect to a direction perpendicular to the conveyance direction A1 in a horizontal plane. In this case, the detection distance at which the laser displacement meter 30 detects the tablet T being conveyed corresponds to length L2 in FIG. 8. On the other hand, when the laser displacement meter 30 is arranged so as to emit laser beams in a direction perpendicular to the conveyance direction A1 in a horizontal plane (see alternate long and short dash line in FIG. 8), the detection distance at which the laser displacement meter 30 detects the tablet T being conveyed corresponds to length L3 in FIG. 8 (L3<L2). Therefore, by arranging the laser displacement meter 30 so as to emit laser beams toward the upstream side in the conveyance direction A1 at the predetermined angle C1 with respect to a direction perpendicular to the conveyance direction A1 in a horizontal plane, it is possible to lengthen the detection distance at which the laser displacement meter 30 detects the tablet T being conveyed. This improves the accuracy of detecting the presence or absence of a split line on the upper surface of the tablet T.

Figure 9:
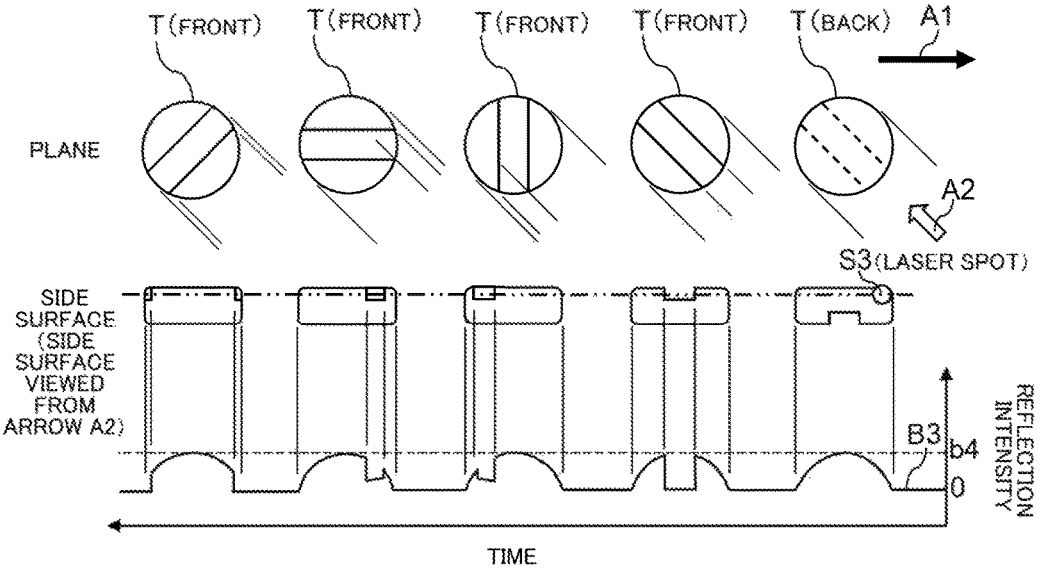
FIG. 9 is a diagram for explaining front/back determination (determination of the presence or absence of a split line) and orientation determination (determination of the orientation of the split line) for tablets according to the second embodiment.

As illustrated in FIG. 9, the laser spot S3 of the laser displacement meter 30 is set to pass the upper part of the side surfaces of the tablets T relatively moving. The output (reflection intensity of laser beams) B3 of the laser displacement meter 30 varies according to the change in the separation distance between the laser displacement meter 30 and the side surface of the tablet T on the conveyor belt 11. For example, the output B3 is zero when there is no tablet T on the conveyor belt 11. When the laser spot S3 is located on the side surface of the tablet T on the conveyor belt 11, the output B3 gradually increases to the maximum reflection intensity b4, and then gradually decreases. At this time, when the laser spot S3 is located on the split line of the tablet T on the conveyor belt 11, the output B3 of the laser displacement meter 30 abruptly drops. Since the output B3 varies depending on the circumferential shape of the upper part of the side surface (outer circumferential surface) of the tablet T on the conveyor belt 11, in other words, the laser displacement meter 30 detects a part of the circumferential shape at the upper part of the side surface of the tablet T on the conveyor belt 11.

The determination unit 81 determines whether there is a split line on the upper surface of the tablet T on the conveyor belt 11 based on the output B3 of the laser displacement meter 30. For example, when the waveform shape of the output B3 is different from a predetermined waveform shape (the output B3 rises or falls smoothly as illustrated at the right end in FIG. 9) or when the output B3 rises or falls abruptly (e.g., the output B3 rises or falls at a predetermined inclination or steeper), the determination unit 81 determines that there is a split line on the upper surface of the tablet T. On the other hand, when the waveform shape of the output B3 corresponds to a predetermined waveform shape or when the output B3 does not change abruptly (e.g., the output B3 does not rise or fall at a predetermined inclination or steeper), the determination unit 81 determines that there is no split line on the upper surface of the tablet T.

Besides, the determination unit 81 acquires the position information of the tablet T (e.g., the position of the tablet T in a horizontal plane) and the orientation information (e.g., the inclination of the split line of the tablet T in a horizontal plane) based on the output B3 of the laser displacement meter 30. For example, the determination unit 81 determines the position of the tablet T on the conveyor belt 11 from the separation distance between the tablet T on the conveyor belt 11 and the laser displacement meter 30 based on the waveform shape of the output B3. Further, the determination unit 81 determines the inclination angle of the split line of the tablet T with respect to the conveyance direction A1, i.e., the orientation (angle and rotation direction) of the split line, based on the waveform shape of the output B3. The orientation of the split line is determined in the same manner as described in the first embodiment. That is, the relationship between the waveform shapes of the output B3 and the orientation of the split line is obtained beforehand and stored in the determination unit 81. The determination unit 81 compares the waveform shape of the actual output B with the data stored to make a determination. The position information and the orientation information are used for the printing process performed by the control unit 80.

Even in the case where the direction in which the split line of the tablet T extends is perpendicular to the direction of laser beams irradiated from the laser displacement meter 30 (see the leftmost tablet T in FIG. 9), a step is always present on the side surface of the tablet T. Accordingly, the waveform shape of the output B3 is different from a predetermined waveform shape due to this step, or the output B3 rises or falls abruptly. Therefore, it is possible to determine the presence or absence of a split line on the upper surface of the tablet T. In addition, the orientation of the split line can be detected according to the place where a signal corresponding to the split line is generated in the waveform shape of the output B3.

In this manner, the orientation information and the position information of the tablet T can be acquired by using the laser displacement meter 30. This eliminates the need of the imaging units 40, resulting in further simplification of the device and reduction of the device cost. Further, it is possible to omit image processing for acquiring the orientation information and the position information of the tablet T from images captured by the imaging units 40, resulting in an improvement in the printing speed.

As described above, according to the second embodiment, the same effects as those of the first embodiment can be achieved. Further, it is possible to acquire the orientation information and the position information of the tablet T using the laser displacement meter 30. This eliminates the need of the imaging units 40. As a result, it is possible to realize further simplification of the device, reduction of the device cost, and an improvement in the printing speed. In addition, only one laser displacement meter 30 is provided for each of the conveyor belts 11, and the number of the laser displacement meters 30 can be reduced. Thereby, the simplification of the device and the reduction of the device cost can be realized more reliably.

Although the laser displacement meter 30 is arranged so as to irradiate laser beams to the upper part of the side surface of the tablet T on the conveyor belt 11, it is not so limited. The laser displacement meter 30 may be arranged so as to irradiate laser beams to the lower part of the side surface of the tablet T on the conveyor belt 11. In this case, it is determined whether there is a split line on the lower surface of the tablet T. When there is a split line on the lower surface of the tablet T, it is determined that there is no split line on the upper surface of the tablet T. When there is no split line on the lower surface of the tablet T, it is determined that there is a split line on the upper surface of the tablet T. In this manner, it is possible to determine the presence or absence of a split line on the upper surface of the tablet T indirectly.

Third Embodiment

Figure 10:
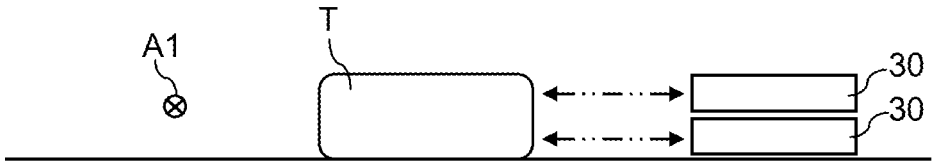
FIG. 10 is a side view for explaining the laser beam irradiation of a laser displacement meter according to a third embodiment.

A third embodiment will be described with reference to FIG. 10. In the third embodiment, differences (arrangement of the laser displacement meter) from the second embodiment will be described, and other explanation will be omitted. In the third embodiment, two laser displacement meters 30 are provided for each of the conveyor belts 11. In FIG. 10, the tablet T is conveyed from the front side to the back side of the paper.

As illustrated in FIG. 10, the two laser displacement meters 30 are arranged to vertically overlap each other. As in the second embodiment, the upper laser displacement meter 30 is arranged so as to emit laser beams in the horizontal direction and irradiate the laser beams to the upper part of the side surface of the tablet T on the conveyor belt 11. The lower laser displacement meter 30 is arranged so as to emit laser beams in the horizontal direction and irradiate the laser beams to the lower part of the side surface of the tablet T on the conveyor belt 11. With this, it is possible to directly detect the presence or absence of a split line on both the front and back surfaces of the tablet T, thereby improving the accuracy of determining the front/ back of the tablet T. In other words, erroneous detection can be prevented by detecting the presence or absence of a split line at two places.

As described above, according to the third embodiment, the same effects as those of the second embodiment can be achieved. Further, it is possible to directly detect the presence or absence of a split line on both the front and back surfaces of the tablet T, thereby improving the accuracy of determining the front/back of the tablet T. In addition, it is possible to acquire orientation information relating to the inclination of the split line on the lower surface of the tablet T by using the lower laser displacement meter 30.

There is a case where printing is performed on a surface having no split line except a surface having a split line. In this case, for example, printing may be performed on the surface with no split line along the split line on the opposite surface or so as to avoid a position corresponding to the split line on the opposite surface. For this reason, orientation information relating to the orientation of the split line on the lower surface of the tablet T is required. The orientation information can be acquired by the lower laser displacement meter 30. Thereby, printing can be performed on the surface with no split line along the split line on the opposite surface or so as to avoid a position corresponding to the split line on the opposite surface based on the orientation information.

Fourth Embodiment

Figure 11:
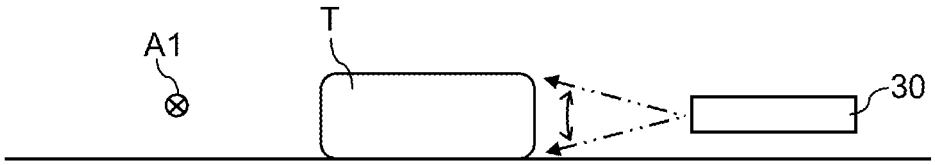
FIG. 11 is a side view for explaining the laser beam irradiation of a laser displacement meter according to a fourth embodiment.

A fourth embodiment will be described with reference to FIG. 11. In the fourth embodiment, differences (type of the laser displacement meter) from the second embodiment will be described, and other explanation will be omitted. In the fourth embodiment, as in the second embodiment, one laser displacement meter 30 is provided for each of the conveyor belts 11. In FIG. 11, the tablet T is conveyed from the front side to the back side of the paper.

As illustrated in FIG. 11, the laser displacement meter 30 emits laser beams in the horizontal direction and scans the laser beams in the vertical direction, thereby irradiating the laser beams to the full width of the side surface of the tablet T conveyed by the conveyor belt 11 in a direction intersecting the conveyance direction A1 (e.g., the height direction perpendicular to the conveyance direction A1). With this, it is possible to directly detect the presence or absence of a split line on both the front and back surfaces of the tablet T, thereby improving the accuracy of determining the front/back of the tablet T.

As described above, according to the fourth embodiment, the same effects as those of the second embodiment can be achieved. Further, it is possible to directly detect the presence or absence of a split line on both the front and back surfaces of the tablet T, thereby improving the accuracy of determining the front/back of the tablet T. In addition, it is possible to acquire orientation information relating to the orientation of the split line on the lower surface of the tablet T by using the lower laser displacement meter 30. The orientation of the split line on the lower surface of the tablet T can be obtained in the same manner as described in the second embodiment. Thus, as in the third embodiment, printing can be performed on the surface with no split line along the split line on the opposite surface or so as to avoid a position corresponding to the split line on the opposite surface based on the orientation information.

As the laser displacement meter 30 for irradiating laser beams to the full width of the side surface of the tablet T on the conveyor belt 11 in a direction intersecting the conveyance direction A1, any laser displacement meter may be used as long as it can irradiate laser beams to the full width of the side surface of the tablet T in a direction intersecting the conveyance direction A1. For example, various laser displacement meters such as the one that irradiates elongated line-shaped laser beams may be used instead of the above-described laser displacement meter that scans laser beams.

Fifth Embodiment

A fifth embodiment will be described with reference to FIG. 12. In the fifth embodiment, differences (arrangement of the laser displacement meter) from the second embodiment will be described, and the other explanation will be omitted. In the fifth embodiment, two laser displacement meters 30 are provided for each of the conveyor belts 11.

Figure 12:
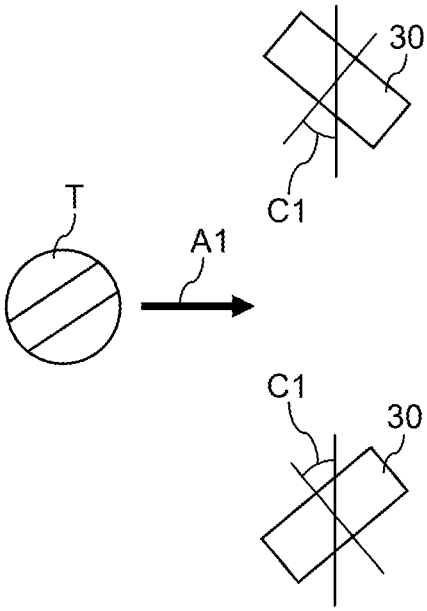
FIG. 12 is a plan view for explaining the laser beam irradiation of a laser displacement meter according to a fifth embodiment.

As illustrated in FIG. 12, the two laser displacement meters 30 are arranged in a direction intersecting (e.g., perpendicular to) the conveyance direction A1 in a horizontal plane so as to interpose a conveyance path for conveying the tablet T by the conveyor belt 11. The laser displacement meters 30 irradiate laser beams to the tablet T on the conveyor belt 11 so as to sandwich them. The upper part of the side surface of the tablet T is irradiated with the laser beams from the laser displacement meters 30. With this, the determination unit 81 can figure out the whole circumferential shape of the upper part of the side surface of the tablet T based on the waveform shape of the output of the two laser displacement meters 30. This makes it possible to reliably determine the presence or absence of a split line on the upper surface of the tablet T. Moreover, orientation information and position information of the tablet T can be obtained accurately.

As described above, according to the fifth embodiment, the same effects as those of the second embodiment can be achieved. Further, it is possible to detect the whole circumferential shape of the upper part of the tablet T. This makes it possible to reliably determine the presence or absence of a split line on the upper surface of the tablet T. As a result, the accuracy of determining the front/back of the tablet T can be improved. In addition, orientation information and position information of the tablet T can be obtained more accurately. Thus, the printing accuracy can be improved.

Other Embodiments

In the above embodiments, the two conveyor belts 11 are used, i.e., there are two conveying lanes; however, it is not so limited. For example, there may be one lane, three lanes, or four lanes. The number of conveying lanes is not particularly limited.

In the above embodiments, one print head is used as the printing unit 50; however, it is not so limited. For example, a plurality of print heads may be used. The number of print heads is not particularly limited. Besides, although a print head having a line of the nozzles 51 has been described as an example of the inkjet print head, it is not so limited. For example, a print head having a plurality of lines of the nozzles 51 may be used.

In the above embodiments, various arrangements of the laser displacement meters 30 are exemplified. However, the arrangement is not limited thereto, and the arrangements of the laser displacement meters 30 according to the first to fifth embodiments may be combined as appropriate. For example, any one of the second to fifth embodiments may be combined with the first embodiment, or either or both of the third and fourth embodiments may be combined with the fifth embodiment.

In the second to fifth embodiments, the laser displacement meter 30 is described as being arranged so as to emit laser beams toward the upstream side in the conveyance direction A1; however, it is not so limited. The laser displacement meter 30 may be arranged so as to emit laser beams toward the downstream side in the conveyance direction A1. When there are two laser displacement meters 30, one of them may be arranged so as to emit laser beams toward the upstream side in the conveyance direction A1 and the other may be arranged so as to emit laser beams toward the downstream side in the conveyance direction A1. Alternatively, both of them may be arranged so as to emit laser beams toward the downstream side in the conveyance direction A1.

In the above embodiments, a set including the conveyor 10, the laser displacement meters 30, the imaging units 40, the printing unit 50, and the drying unit 60 performs printing on the upper surface of the tablet T; however, it is not so limited. For example, there may be provided two sets of them to perform printing on both sides of the tablet T. In this case, as an example, a second conveyor 10 is arranged below a first conveyor 10. The second conveyor 10 is configured to be capable of receiving the tablet T from the first conveyor 10. For example, when the tablet T conveyed by the first conveyor 10 reaches a predetermined position under the first conveyor 10, the tablet T is released from the state of being held by the first conveyor 10 and drops. The tablet T is received by the second conveyor 10 located thereunder. On this occasion, both the tablet T having printing on its front surface and the tablet T having no printing are delivered from the first conveyor 10 to the second conveyor 10. At this time, the tablets T are reversed, and the printed front surface faces down, while the unprinted back surface faces up. The printing unit 50 on the side of the first conveyor 10 performs printing on the surface of the tablet T facing up.

For example, when information obtained by the imaging unit 40 on the side of the first conveyor 10 can be used in printing on the side of the second conveyor 10, the imaging unit 40 on the side of the second conveyor 10 is not required. Besides, for example, on the side of the second conveyor 10, only one of the laser displacement meters 30 and the imaging unit 40 may suffice. In addition, when both the front and back split lines can be detected on the side of the first conveyor 10, the detection result may be used on the side of the second conveyor 10. Further, printing may be performed on the back surface correspondingly to the orientation of the split line on the printed front surface.

The output of the laser displacement meter 30 is described as being based on the reflection intensity (received light amount); however, it is not so limited. The output of the laser displacement meter 30 may be based on the time from when laser beams are irradiated until when the laser beams reflected on the surface of the tablet T are received by the laser displacement meter.

The above-described tablets may include tablets for pharmaceutical use, edible use, cleaning, industrial use, and aromatic use. Examples of the tablet include a plain tablet (uncoated tablet), a sugar-coated tablet, a film-coated tablet, an enteric coated tablet, a gelatin coated tablet, a multilayered tablet, a dry-coated tablet, and the like. Examples of the tablet further include various capsule tablets such as hard capsules and soft capsules. The tablets may be in a variety of shapes such as, for example, a disk shape, a lens shape, a triangle shape, an oval shape, and the like.

In the case where tablets to be printed are for pharmaceutical use and edible use, edible ink is suitably used. Specifically, edible pigments such as Amaranth, Erythrosine, New Coccine (red), Tartrazine, Sunset Yellow FCF, β-Carotene, Crocin (yellow), Brilliant Blue FCF, Indigo Carmine (blue), or the like are dispersed or dissolved in a vehicle, and, if necessary, a pigment dispersant (surfactant) is blended therein, the resultant of which can be used. As the edible ink, any of synthetic dye ink, natural color ink, dye ink, and pigment ink may be used.

While certain embodiments have been described, these embodiments have been presented by way of example only, and are not intended to limit the scope of the inventions. Indeed, the novel embodiments described herein may be embodied in a variety of other forms; further, various omissions, substitutions and changes in the form of the embodiments described herein may be made without departing from the spirit of the inventions. The accompanying claims and their equivalents are intended to cover such forms or modifications as would fall within the scope and spirit of the inventions.

EXPLANATION OF SYMBOLS

1: Tablet printing device
1: Conveyor
30: Laser displacement meter
50: Printing unit
81: Determination unit
T: Tablet

The invention claimed is:

1. A tablet printing apparatus, comprising:
a conveyer configured to convey a tablet;
a laser displacement meter configured to emit laser beams to the tablet conveyed by the conveyer and receive the laser beams reflected by the tablet;
a determination unit configured to determine orientation of a split line on the tablet conveyed by the conveyer based on a waveform shape of an output value from the laser displacement meter; and
a printing unit configured to perform printing on the tablet conveyed by the conveyer based on a determination result obtained by the determination unit.

2. The tablet printing apparatus according to claim 1, wherein
the laser displacement meter includes a plurality of laser displacement meters configured to emit the laser beams to the upper surface of the tablet conveyed by the conveyer, and
the laser displacement meters are arranged in a direction intersecting conveyance direction of the tablet in a horizontal plane.

3. The tablet printing apparatus according to claim 2, wherein the determination unit is further configured to determine the orientation of the split line on the tablet conveyed by the conveyer based on a combination of waveform shapes of output values from the laser displacement meter.

4. The tablet printing apparatus according to claim 3, wherein the determination unit is further configured to determine the orientation of the split line on the tablet conveyed by the conveyer based on time at which an output value corresponding to a portion of the split line in the upper surface of the tablet is acquired and time at which an output value corresponding to other portions than the split line in the upper surface of the tablet is acquired, in the waveform shapes of the output values from the laser displacement meter.

5. The tablet printing apparatus according to claim 1, wherein the laser displacement meter is arranged to emit the laser beams to a side surface of the tablet conveyed by the conveyer.

6. The tablet printing apparatus according to claim 5, wherein the laser displacement meter includes a first laser displacement meter and a second laser displacement meter, the first laser displacement meter is arranged to emit the laser beams to an upper part of the side surface of the tablet conveyed by the conveyer, and the second laser displacement meter is arranged to emit the laser beams to a lower part of the side surface of the tablet conveyed by the conveyer.

7. The tablet printing apparatus according to claim 5, wherein the laser displacement meter includes a first laser displacement meter and a second laser displacement meter, and the first laser displacement meter and the second laser displacement meter are arranged with a conveyance path for conveying the tablet therebetween in a direction intersecting conveyance direction of the tablet.

8. A tablet printing method, comprising:

emitting laser beams with a laser displacement meter to a tablet conveyed and receiving the laser beams reflected by the tablet;

determining orientation of a split line on the tablet conveyed based on a waveform shape of an output value from the laser displacement meter; and performing printing on the tablet conveyed based on a determination result.

9. The tablet printing method according to claim 8, wherein, in the emitting and the receiving, the laser beams are emitted to the upper surface of the tablet conveyed from a plurality of positions arranged in a direction intersecting conveyance direction of the tablet in a horizontal plane.

10. The tablet printing method according to claim 9, wherein, in the determining, the orientation of the split line on the tablet conveyed by the conveyer is determined based on a combination of waveform shapes of output values from the laser displacement meter.

11. The tablet printing method according to claim 10, wherein, in the determining, the orientation of the split line on the tablet conveyed by the conveyer is determined based on time at which an output value corresponding to a portion of the split line in the upper surface of the tablet is acquired and time at which an output value corresponding to other portions than the split line in the upper surface of the tablet is acquired, in the waveform shapes of the output values from the laser displacement meter.

12. The tablet printing method according to claim 8, wherein, in the emitting and the receiving, the laser beams are emitted to a side surface of the tablet conveyed.

13. The tablet printing method according to claim 12, wherein, in the emitting and the receiving, the laser beams are emitted to an upper part and a lower part of the side surface of the tablet conveyed.

14. The tablet printing method according to claim 12, wherein, in the emitting and the receiving, the laser beams are emitted to the side surface of the tablet conveyed from a plurality of positions with a conveyance path for conveying the tablet therebetween in a direction intersecting conveyance direction of the tablet.

15. A tablet printing apparatus, comprising:

a conveyer configured to convey a tablet;

a laser displacement meter configured to emit laser beams to the tablet conveyed by the conveyer and receive the laser beams reflected by the tablet;

a controller including a memory storing data of relationship between a waveform shape of an output value from the laser displacement meter and orientation of a split line on the tablet conveyed by the conveyer, the control configured to determine the orientation of the split line from the data; and a printer configured to perform printing on the tablet conveyed by the conveyer based on a determination result obtained by the controller.

* * * * *